US009568273B2

(12) United States Patent
Thordsen

(10) Patent No.: US 9,568,273 B2
(45) Date of Patent: Feb. 14, 2017

(54) SPORTERIZED FIREARM STOCKS AND METHODS THEREOF

(71) Applicant: Alan T. Thordsen, San Mateo, CA (US)

(72) Inventor: Alan T. Thordsen, San Mateo, CA (US)

( * ) Notice: Subject to any disclaimer, the term of this patent is extended or adjusted under 35 U.S.C. 154(b) by 0 days.

(21) Appl. No.: 14/092,791

(22) Filed: Nov. 27, 2013

(65) Prior Publication Data

US 2014/0144060 A1 May 29, 2014

Related U.S. Application Data

(60) Provisional application No. 61/731,466, filed on Nov. 29, 2012.

(51) Int. Cl.
*F41C 23/00* (2006.01)
*F41C 23/20* (2006.01)
*F41C 23/02* (2006.01)

(52) U.S. Cl.
CPC ..... *F41C 23/20* (2013.01); *F41C 23/02* (2013.01)

(58) Field of Classification Search
CPC ..... F41C 23/00; F41C 23/02; F41C 23/04; F41C 23/06; F41C 23/20
USPC ..... 42/71.01, 72, 73
See application file for complete search history.

(56) References Cited

U.S. PATENT DOCUMENTS

| | | | | |
|---|---|---|---|---|
| 5,933,997 | A * | 8/1999 | Barrett | 42/73 |
| 7,398,616 | B1 * | 7/2008 | Weir | 42/73 |
| 7,886,473 | B2 * | 2/2011 | Rotharmel | F41A 3/66 42/75.03 |
| 8,438,771 | B1 * | 5/2013 | Boone | 42/72 |
| 2006/0096146 | A1 * | 5/2006 | Fitzpatrick et al. | 42/71.01 |
| 2007/0289190 | A1 * | 12/2007 | Oz | 42/73 |
| 2008/0217371 | A1 * | 9/2008 | Wemmer | F41C 33/00 224/579 |
| 2009/0126249 | A1 * | 5/2009 | Crommett | 42/71.01 |
| 2010/0212205 | A1 * | 8/2010 | Nill | 42/73 |

OTHER PUBLICATIONS

Calguns. <http://www.calguns.net/calgunforum/showthread.php?t=253777&page=4>. Calguns.net forum, Featureless Rifles Picture Thread, post #141 by username "youpock". Apr. 24, 2010.*
Calguns2. <http://www.calguns.net/calgunforum/showthread.php?t=110703&page=12>. Calguns.net forum, AR Pistol Pic thread, post #456 by username "glock this".Jan. 2, 2010.*

* cited by examiner

*Primary Examiner* — Gabriel Klein
(74) *Attorney, Agent, or Firm* — Kang S. Lim

(57) ABSTRACT

The present invention provides a sporterized firearms stock ensemble configured to be coupled to a long firearm having a pistol grip interface. The firearm stock ensemble includes a cheek-rest and a gunstock assembly. The cheek-rest is configured to be coupled to a recoil buffer tube of the long firearm. The gunstock assembly includes an inline grip portion, a butt-plate and an elongated support section configured to couple the grip portion to the butt-plate.

15 Claims, 18 Drawing Sheets

1000D

SPORTERIZED FIREARM STOCKS AND METHODS THEREOF

CROSS REFERENCE TO RELATED APPLICATIONS

This non-provisional application claims the benefit of provisional application No. 61/731,466 filed on Nov. 29, 2012, entitled "Sporterized Firearm Stocks and Methods Thereof", which application is incorporated herein in its entirety by this reference.

BACKGROUND

The present invention relates to systems and methods for sporterizing firearms to comply with laws and ordinances while maintaining ease-of-use with minimal deviation from normal firearm operating procedures.

Different types of firearms and firearm accessories have increased steadily over time in both functionality and flexibility, and today, there is a wide variety of firearm modifications and/or accessories available. Innovation in the firearms industry is also driven by legislative trends, as firearm owners are required to respond by sporterizing their firearms and/or accessories.

In recent times, Federal and/or State laws have limited features of semi-automatic firearms and/or also the capacity of firearm magazines. For example, in some jurisdictions, the use of pistol grips with semi-automatic centerfire rifles is strictly regulated. To comply, the pistol grip has to be either replaced with or modified into a sporterized buttstock.

However, modern semi-automatic centerfire firearms designed to be used with pistol grips and corresponding buttstock do not work well with traditional sporterized buttstocks because characteristics such as the grip angle, palm-grip and thumb-rest and cheek-rest, of traditional sporterized rifles are quite different from those of a modern semipistol grip in combination with a corresponding buttstock.

It is therefore apparent that an urgent need exists for specialized sporterized buttstocks which are compatible with long firearms configured to be coupled to pistol grips such as AR-15 variant rifles. These compatible buttstocks should enable users to fully operate the rifles like traditional sporterized rifles while complying with applicable laws and regulations.

SUMMARY

To achieve the foregoing and in accordance with the present invention, sporterized stocks for long firearms configured to be coupled to pistol grips while complying with laws and regulations are provided.

In one embodiment, a sporterized firearms stock ensemble is configured to be coupled to a long firearm having a pistol grip interface. The firearm stock ensemble includes a cheek-rest and a gunstock assembly. The cheek-rest is configured to be coupled to a recoil buffer tube of the long firearm. The gunstock assembly includes a grip portion that is substantially inline with respect to the gunstock assembly. The gunstock assembly also includes a butt-plate and an elongated support section configured to couple the grip portion to the butt-plate. The butt-plate is configured to enable a user to support the long firearm with his/her shoulder.

In some embodiments, the firearms ensemble also includes a sling interface and a buffer tube cover configured to be attached to the recoil buffer tube. The buffer tube cover may include a rail configured to accept a snap on cheek-rest.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute terms, such as, for example, "will," "will not," "shall," "shall not," "must," and "must not," are not meant to limit the scope of the present invention as the embodiments disclosed herein are merely exemplary.

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention.

Figure 1A:
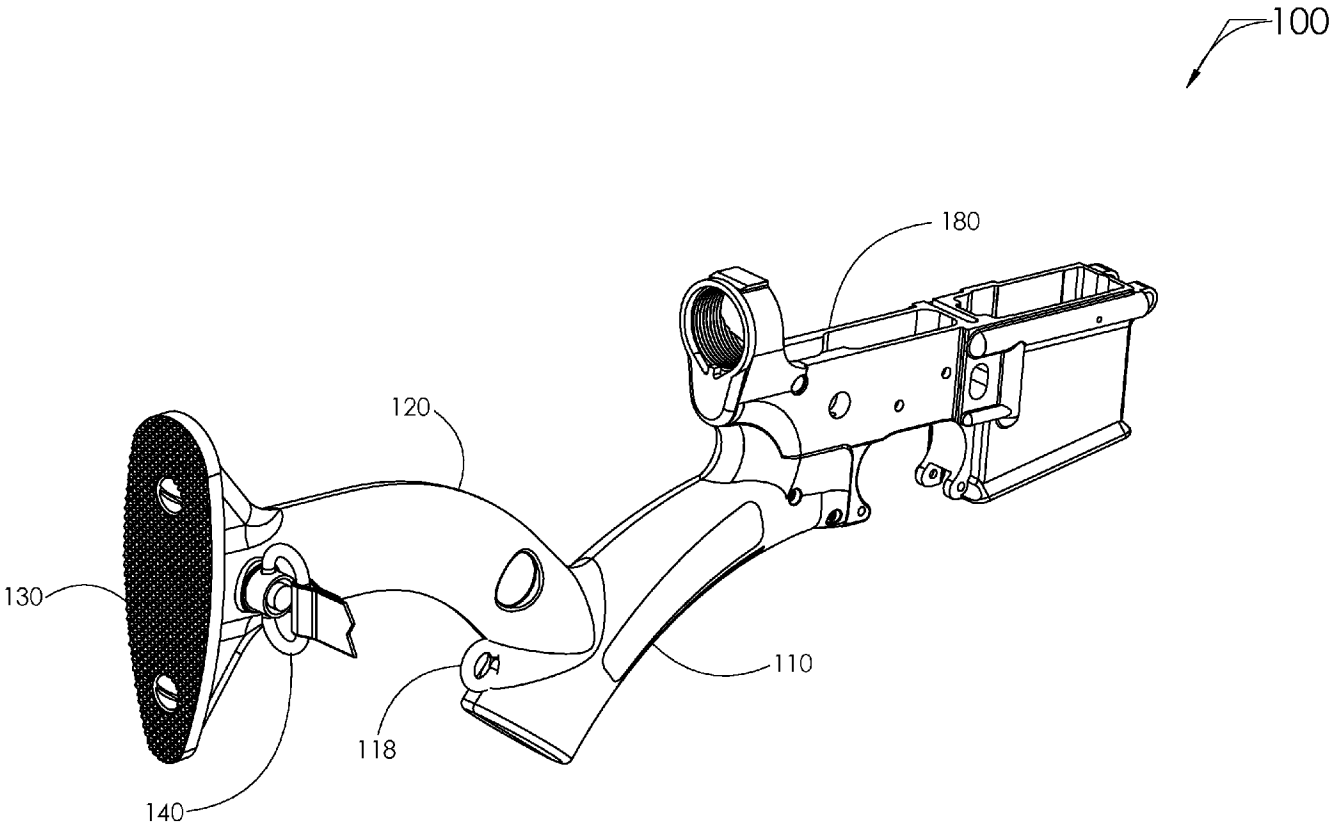
FIGS. 1A and 1B are perspective views of one embodiment of a sporterized butt-stock assembly coupled to an AR variant rifle receiver in accordance with the present invention.
Figure 1B:
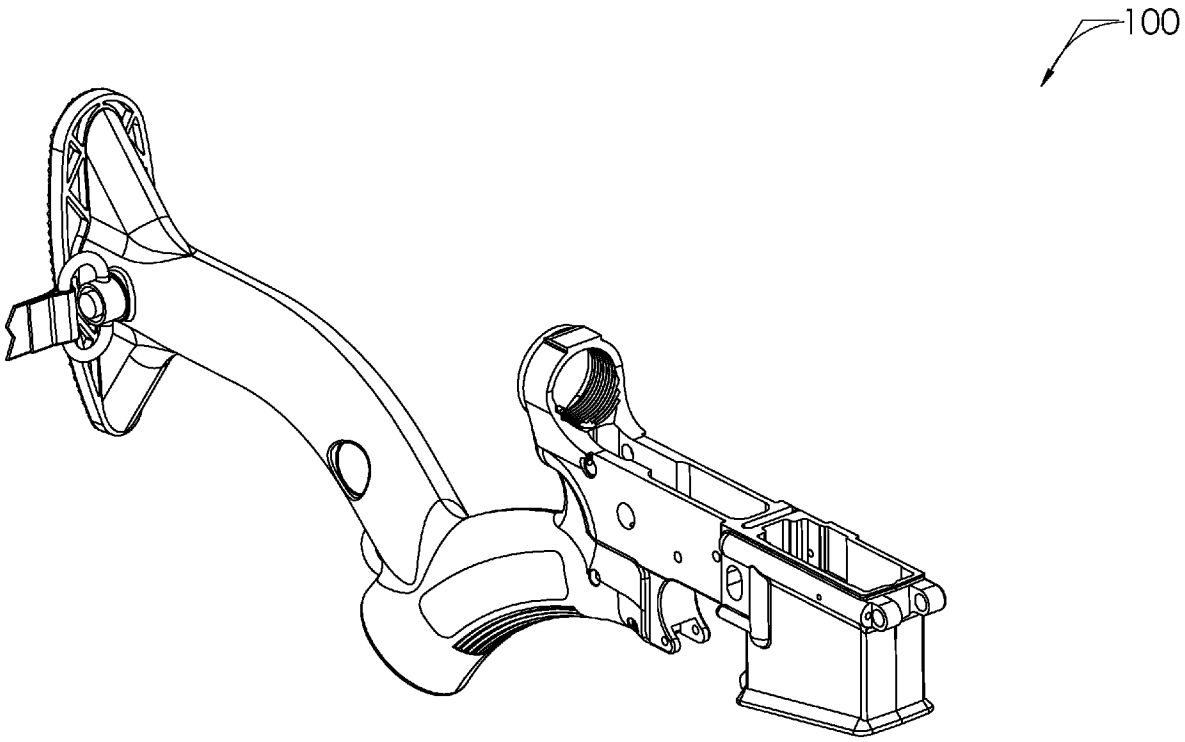
Figure 2:
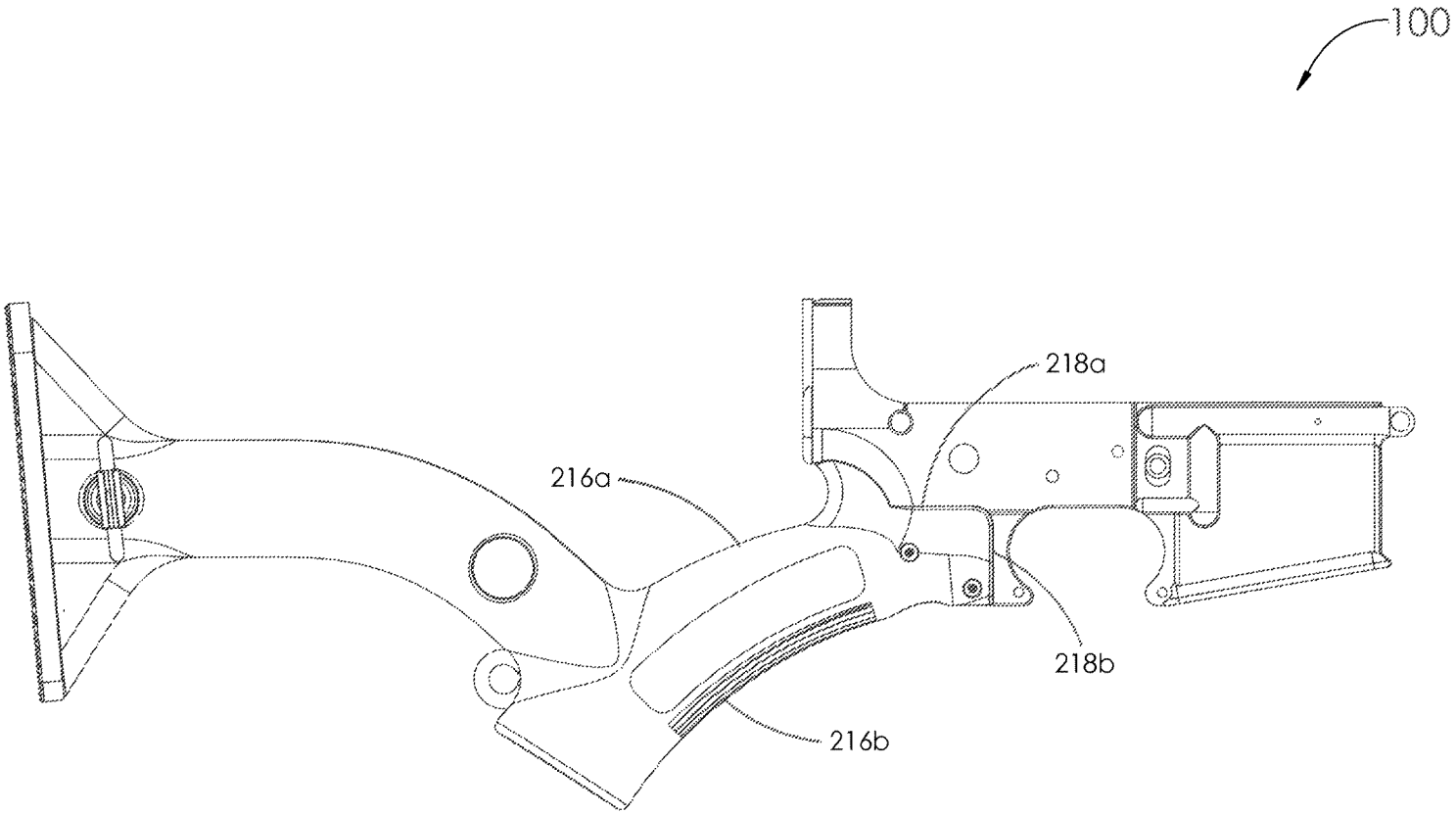
FIG. 2 is a right side view of the embodiment of the sporterized butt-stock assembly of FIG. 1A.
Figure 3:
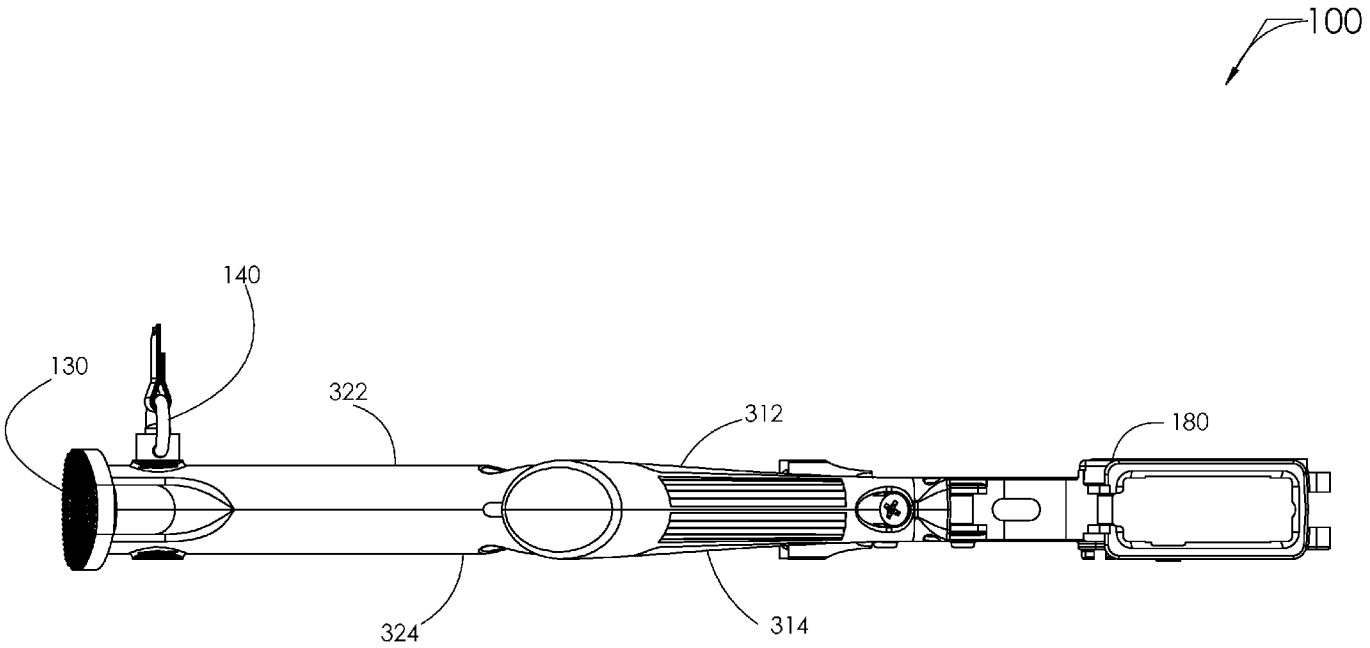
FIG. 3 is a bottom view of the embodiment of the sporterized butt-stock assembly of FIG. 1A.
Figure 4A:
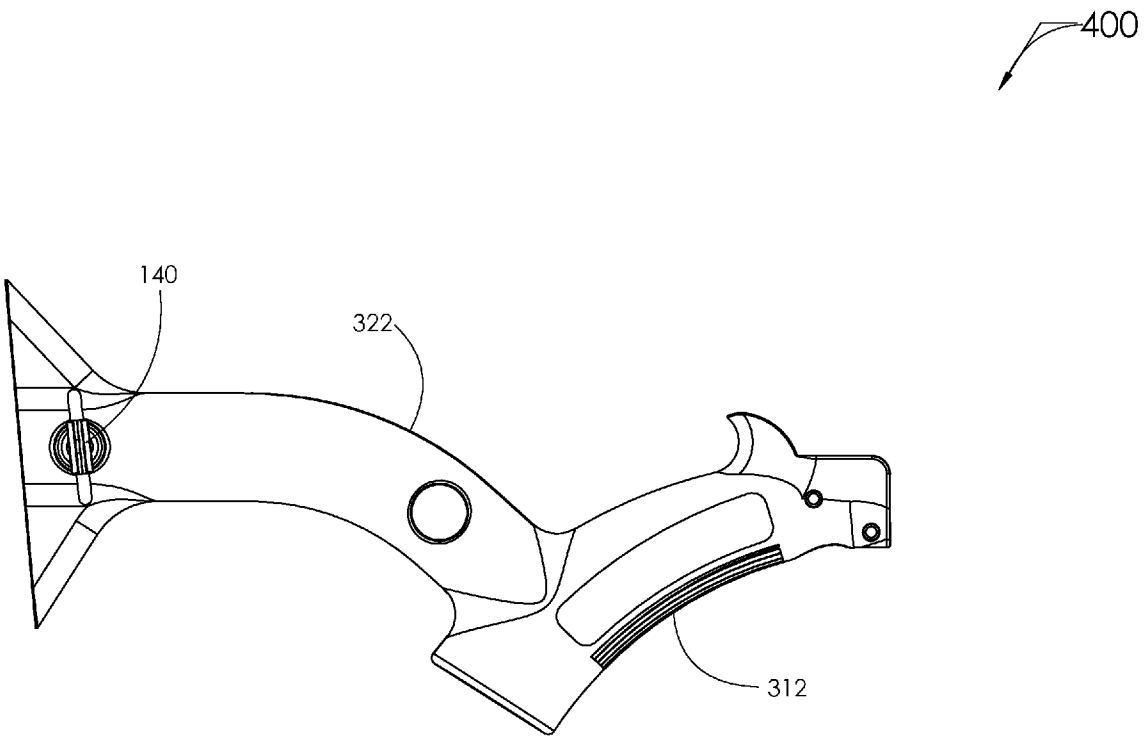
FIGS. 4A and 4B are right side and right perspective external views of the right section of the sporterized butt-stock assembly of FIG. 1A.
Figure 4B:
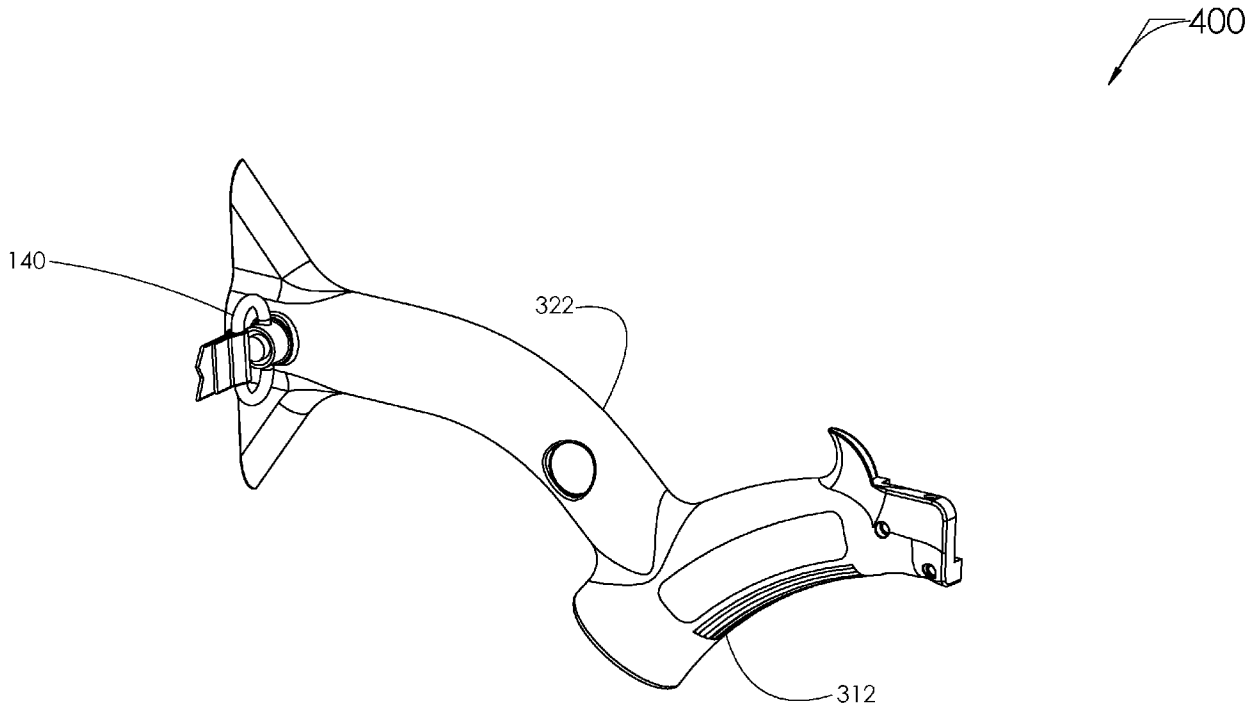
Figure 5A:
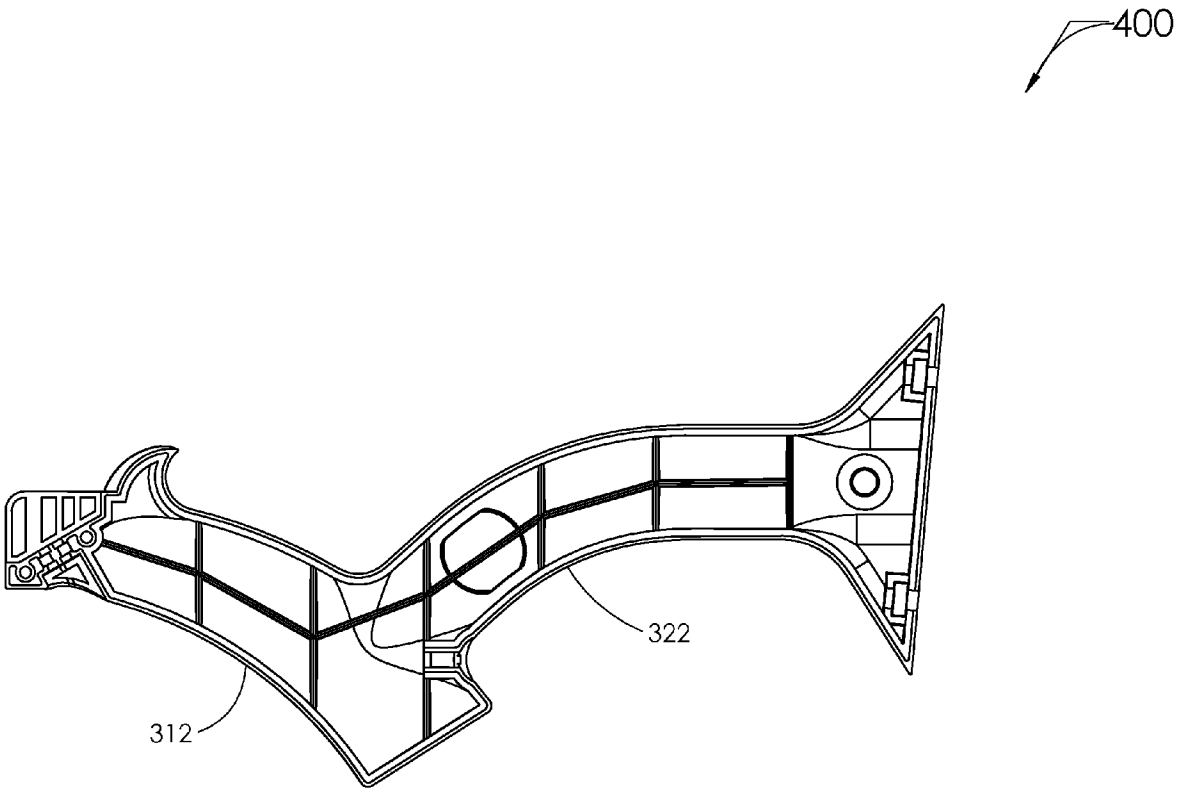
FIGS. 5A and 5B are internal views of the right section of the sporterized butt-stock assembly of FIG. 1A.
Figure 5B:
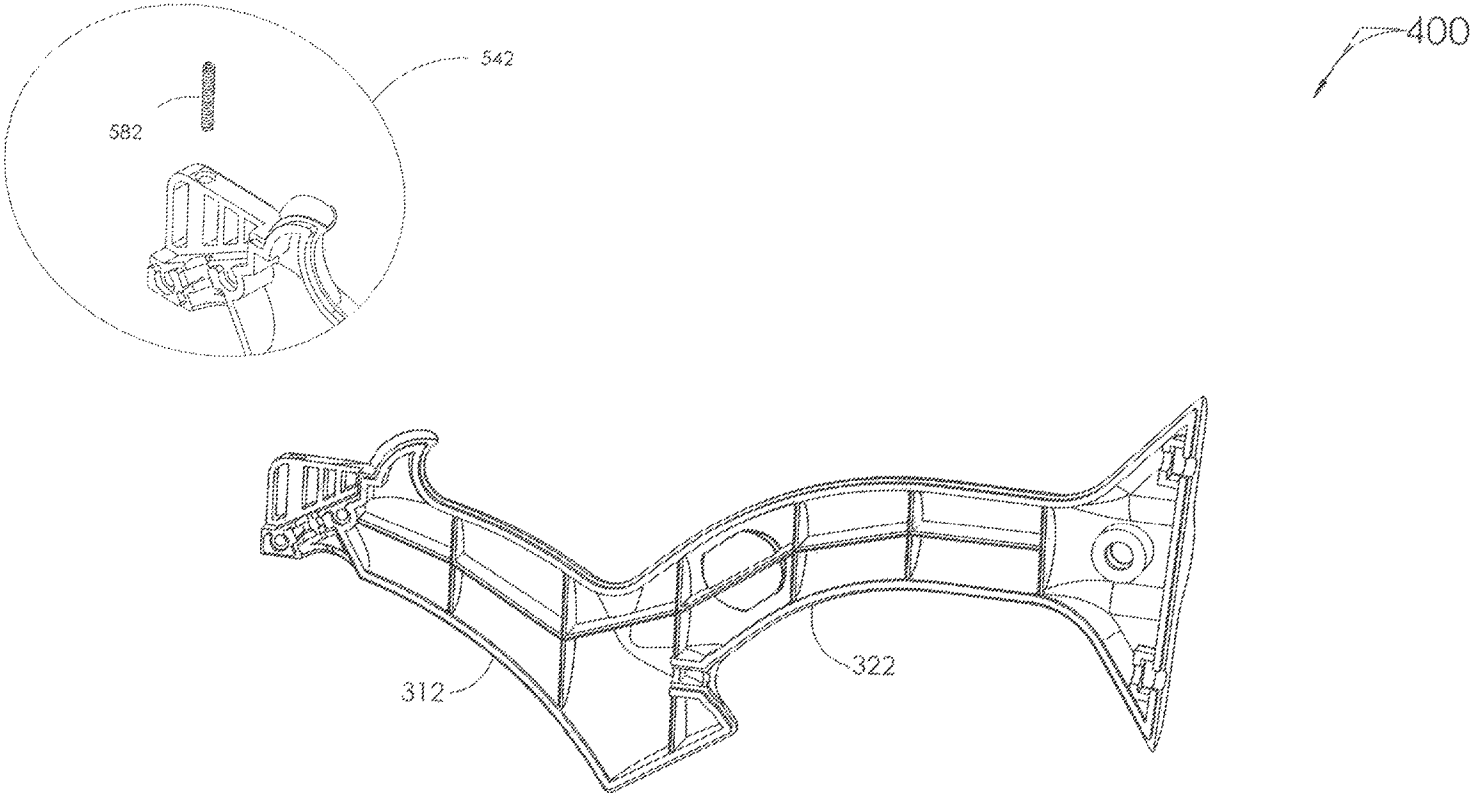

The present invention relates to systems and methods of providing sporterized stocks for long firearms configured to be coupled to pistol grips while complying with laws and regulations. To facilitate discussion, FIGS. 1A and 1B are perspective views 100 of one embodiment of a sporterized stock assembly coupled to a stripped rifle receiver 180 configured to accept a pistol grip, in accordance with the present invention. FIGS. 2 and 3 provide additional right side and bottom views, respectively, of the sporterized stock assembly of FIG. 1A.

Figure 12:
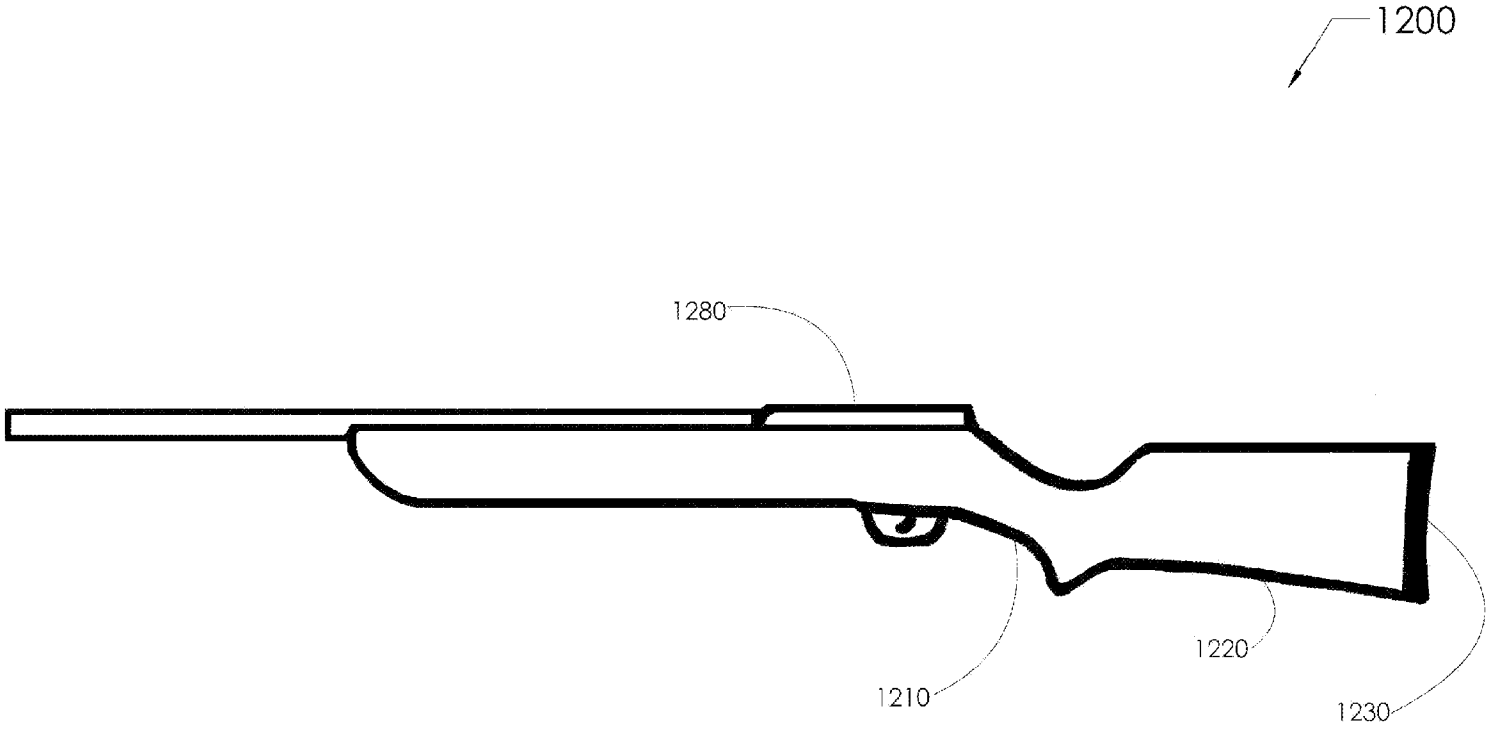
FIG. 12 is a side view of a modern long firearm including a sporterized stock with an inline grip portion.

In this embodiment, the sporterized stock assembly includes an inline grip portion 110, an elongated support section 120, a butt plate 130 and an optional detachable sling swivel 140. Note that the grip angle of the grip portion 110 is substantially similar to the grip angle of the inline grip portion 1210 of the sporterized stock coupled to a modern long firearm receiver 1280 of FIG. 12. As shown in FIG. 2, grip portion 110 includes a convex upper profile 216*a*, a corresponding concave lower profile 216*b*, and a receiver interface having a pair of adjacent surfaces 218*a*, 218*b*.

Figure 6:
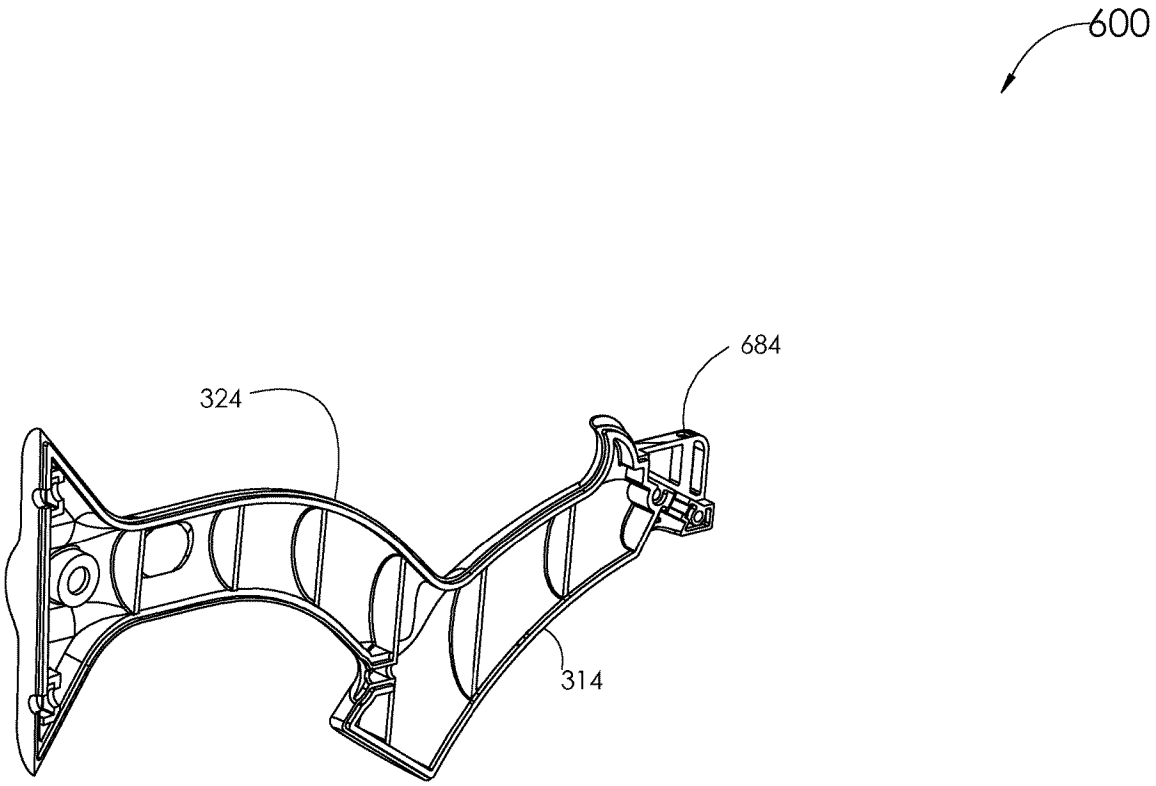
FIG. 6 is an internal perspective view of the left section of the sporterized butt-stock assembly of FIG. 1A.
Figure 7:
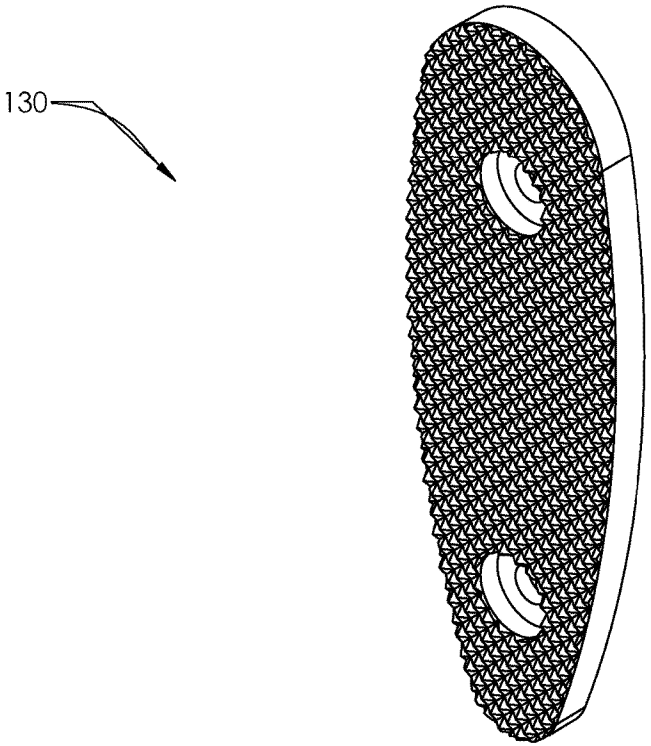
FIG. 7 is a perspective view a butt-plate assembly of the sporterized butt-stock assembly of FIG. 1A.

As shown in the bottom view of FIG. 3, for ease of manufacturing, the sporterized stock assembly of FIG. 1A can include a molded pair of right and left halves with corresponding left and right components, such as right grip portion 312 and left grip portion 314, right elongated support portion 322 and left elongated support portion 324. FIGS. 4A-4B and 5A-5B are the respective external views and internal views of the right half 400 of the sporterized stock assembly including right grip portion 312 and right elongated support portion 322, while FIG. 6 is a perspective internal view of the left half 600 of the sporterized stock assembly including left grip portion 314, left elongated support portion 324, and a block 684 configured to retain a spring (not shown) configured to be operatively coupled to receiver 180. FIG. 7 is a detailed perspective view of the butt plate 130.

Figure 8:
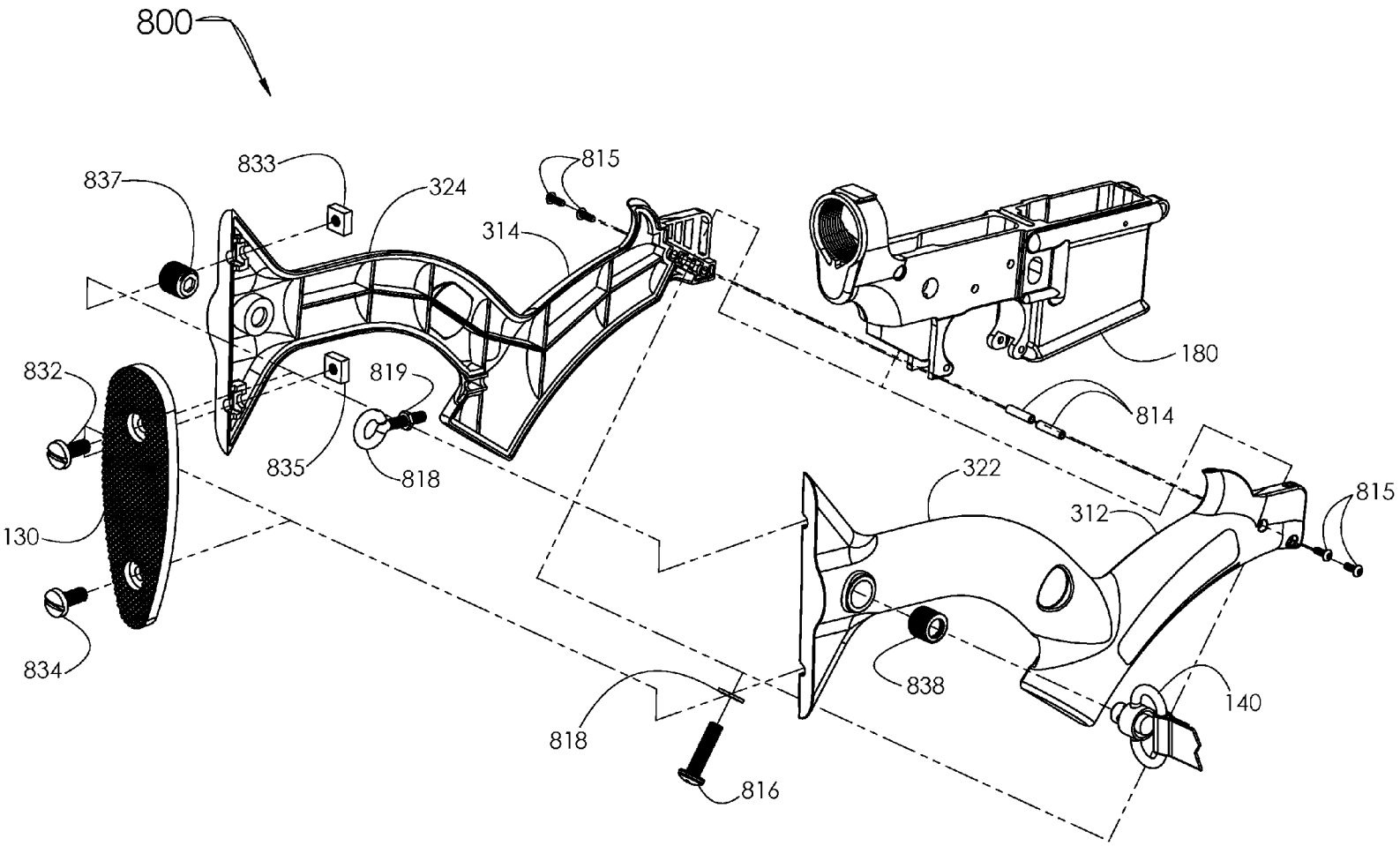
FIG. 8 is an exploded perspective view of the sporterized butt-stock assembly of FIG. 1A in relation to the AR variant rifle receiver.

FIG. 8 is an exploded view 800 illustrating the sporterized stock assembly and the long firearm receiver of FIG. 1A together with the interconnecting hardware, such as screws and nuts. Accordingly, right half 400 is mated to left half 600 by screws 815 and threaded inserts 814, and can be further secured chemical bonding, ultrasonic welding, or molded as one solid piece. Butt plate 130 can then be coupled to the stock assembly with screws 832, 834 and nuts 833, 835 secured inside the stock assembly. Similarly, optional eye-hook 818 can be coupled to the stock assembly with nut 819 secured inside the stock assembly. The entire stock assembly can be secured to firearm receiver 180 with nut 816 and flat washer 818. In some embodiments, right half 400 and left half 600 include quick detach sling mount 837 and sling mount 838, respectively, for attaching sling swivel 140.

Figure 9:
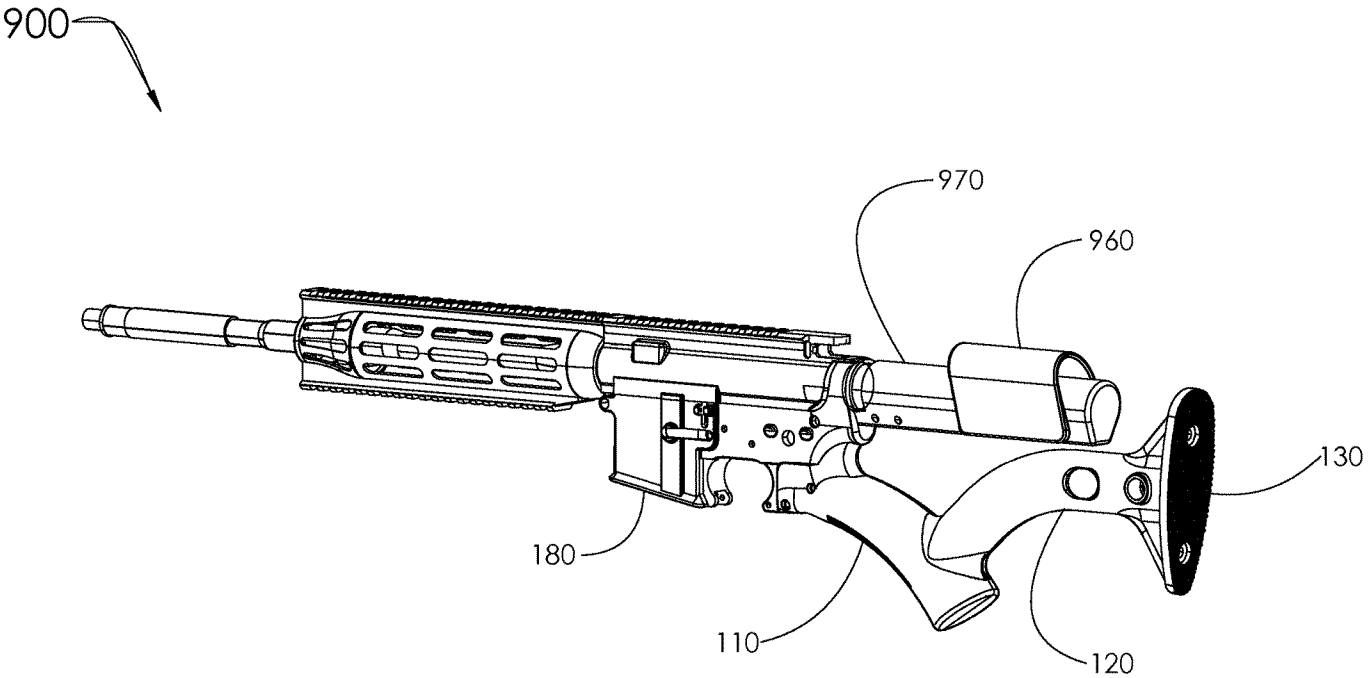
FIG. 9 is a perspective view of an assembled AR variant rifle operatively coupled to a sporterized firearm stock ensemble, including a cheek-rest and the butt-stock assembly of FIG. 1A, in accordance with the present invention.

Referring also to the FIG. 9 which is a perspective view of an assembled long firearm 900 including an upper receiver and a lower receiver 180 coupled to grip portion 110 of the stock assembly. Receiver 180 may be coupled to a recoil buffer tube (not shown). In some embodiments, a buffer tube cover 970 is secured over the recoil buffer tube of the firearm 900. Depending on the user's choice of mechanical and/or optical firearm aiming sight option(s), firearm 900 may also include an optional raised cheek rest 960 attached to buffer tube cover 970.

Figure 10A:
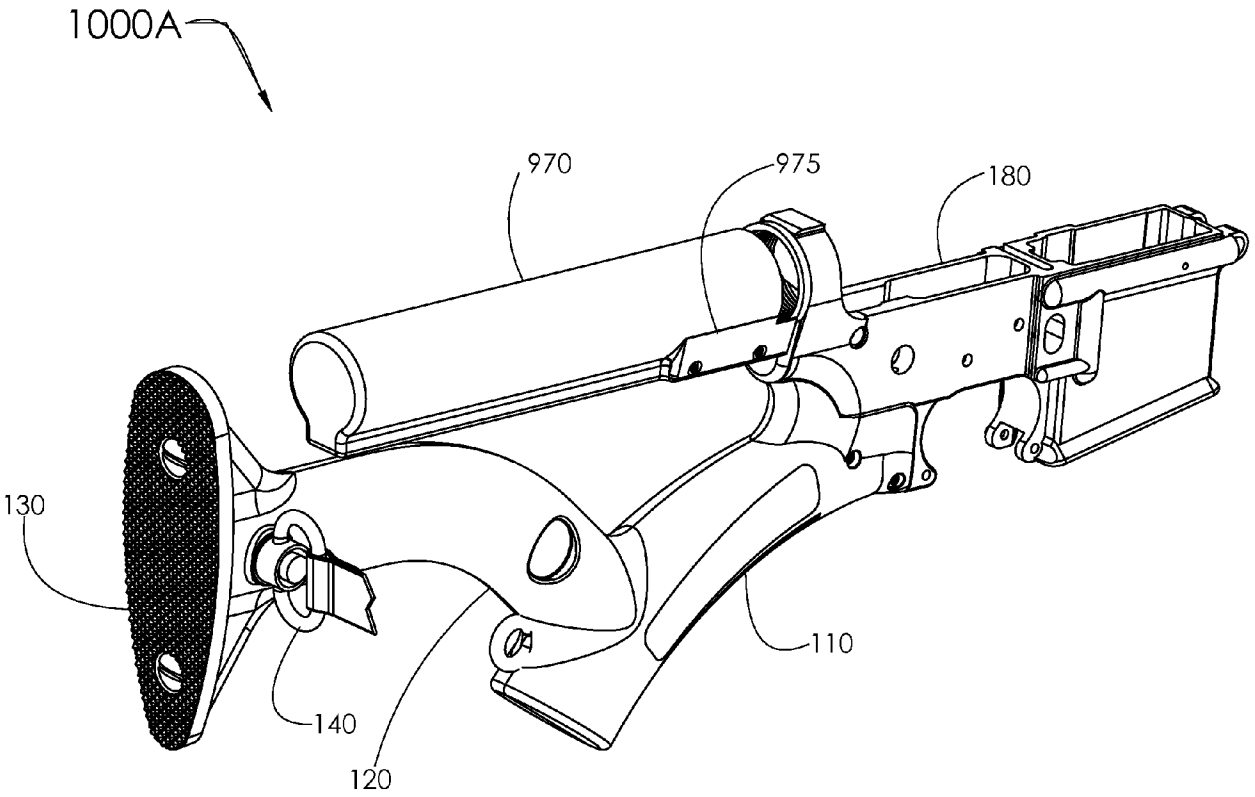
FIGS. 10A-10C are perspective views illustrating three alternate embodiments of the firearm stock ensemble of FIG. 9.
Figure 10B:
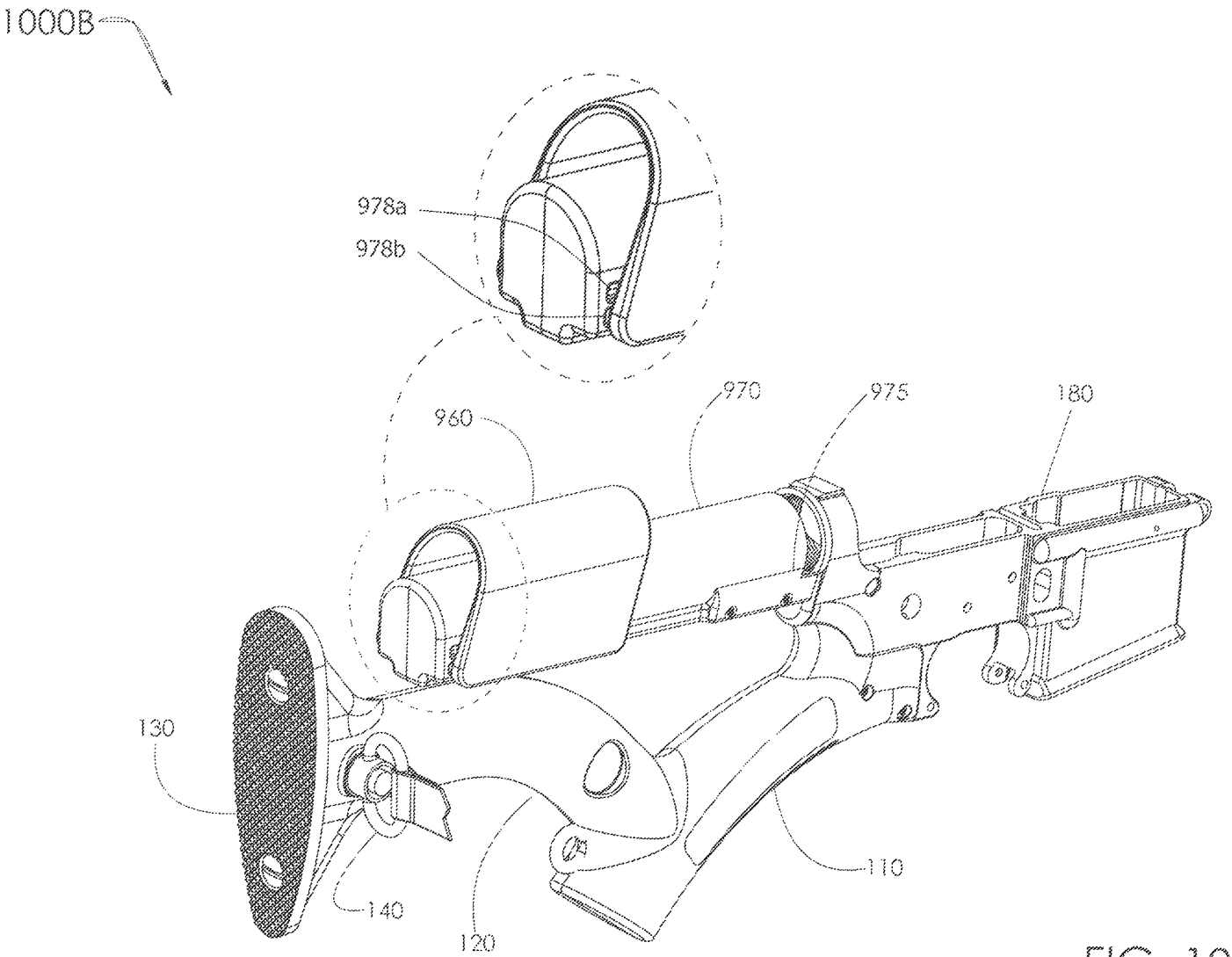
Figure 10C:
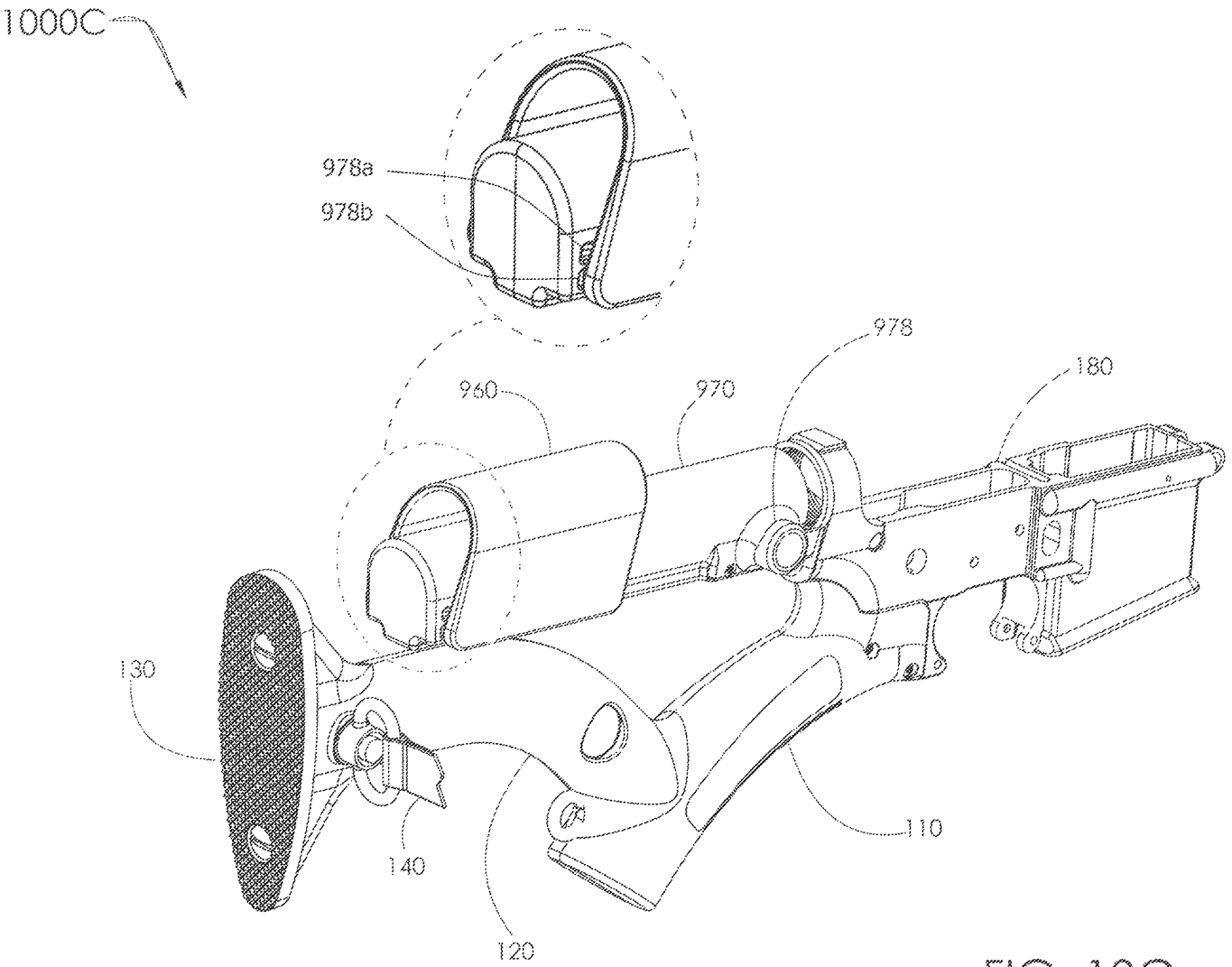

FIGS. 10A, 10B and 10C are right side perspective views illustrating three variants of firearm stock ensemble 1000A, 1000B and 1000C, in accordance with embodiments of the present invention such as long firearm 900. With respect to stock ensemble 1000A, firearm receiver 180 is configured to be coupled to buffer tube cover 970 and secured using coupler block 975.

Figure 10D:
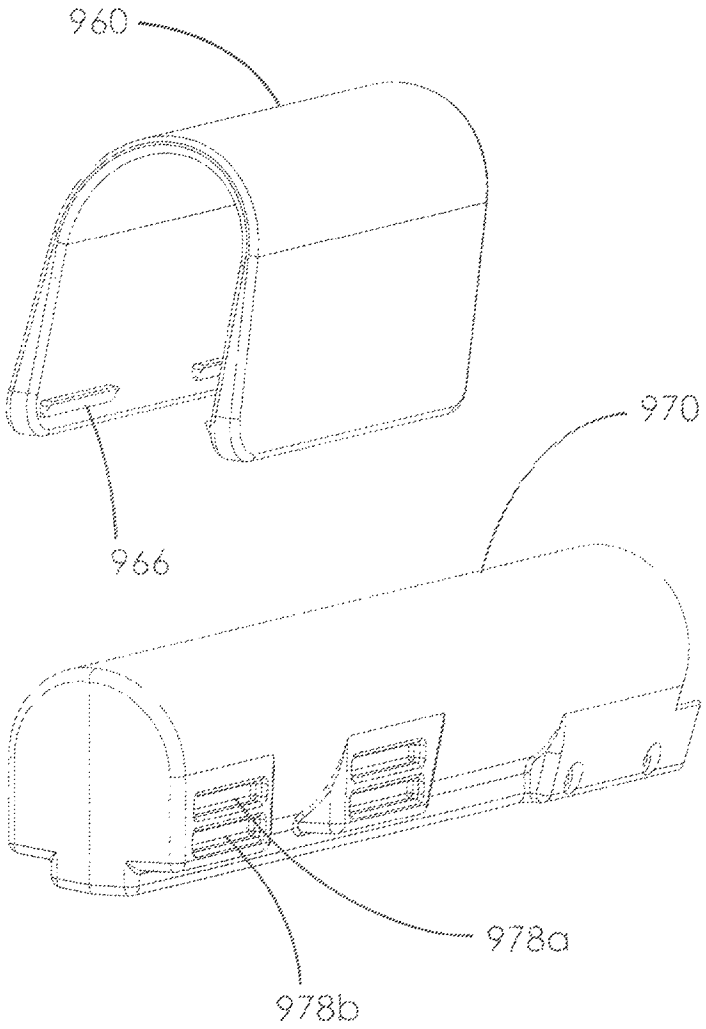
FIG. 10D is a perspective view illustrating an adjustable cheek-rest for an AR variant rifle receiver in accordance with one embodiment of the present invention.

FIG. 10D is a perspective view illustrating an adjustable cheek-rest 960 for an AR variant rifle receiver in accordance with one embodiment of the present invention.

With respect to stock ensemble 1000B, firearm receiver 180 is configured to be coupled to buffer tube cover 970 and secured using coupler block 975. Ensemble 1000B include an optional raised cheek rest 960 configured to align the user's eye with an aiming sight having an elevated aiming point relative to the bore axis of firearm 900, while maintaining an appropriate cheek weld. Cheek rest 960 can also adjustable and can be secured along the buffer tube cover 970 to suit the user's preferred cheek weld position.

With respect to stock ensemble 1000C, firearm receiver 180 is configured to be coupled to buffer tube cover 970 and secured using coupler block 975. Ensemble 1000C also include an optional raised cheek rest 960 configured to align the user with a firearm aiming device having an elevated aiming axis. Ensemble 1000C further includes a coupler block 978 with an integrated sling attachment point configured to be attached to a sling swivel.

Figure 11:
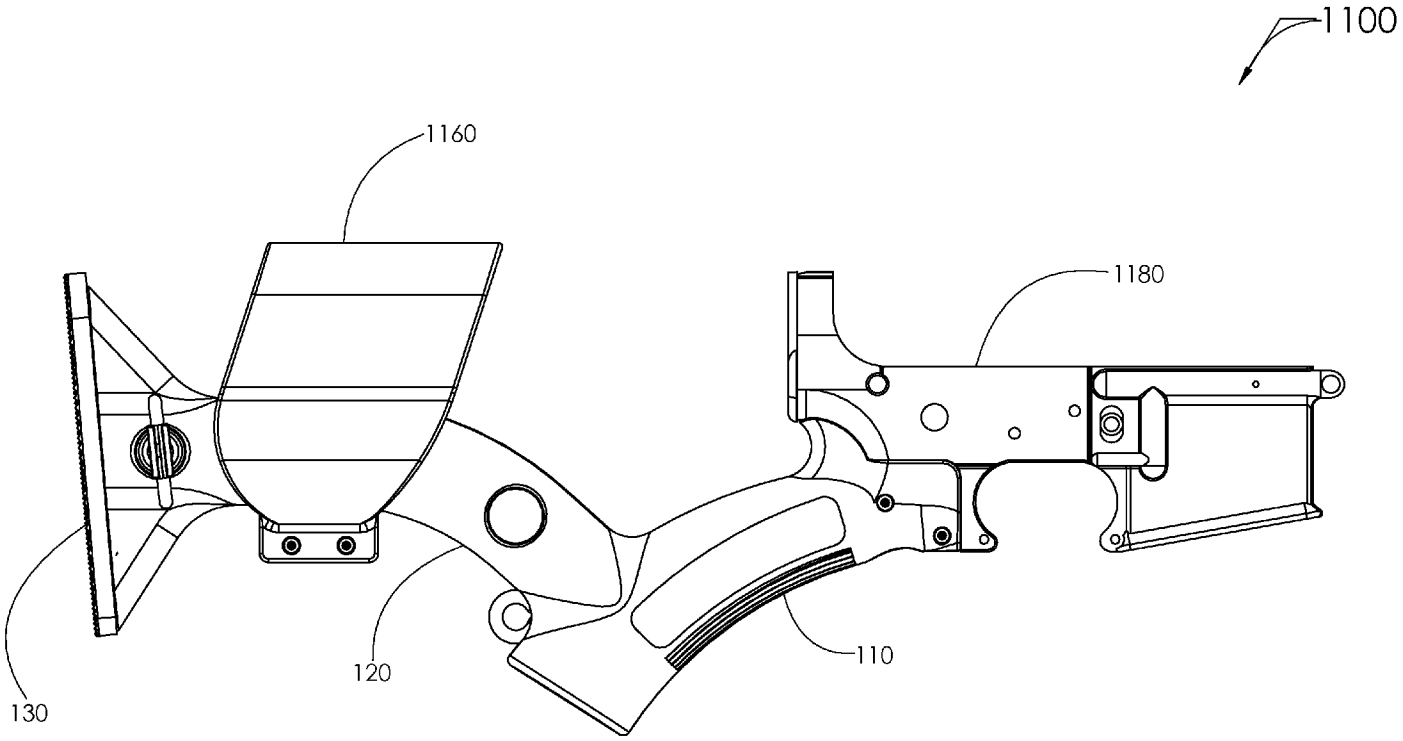
FIG. 11 a side view illustrating another embodiment of a sporterized butt-stock assembly with a detachable cheek rest, the assembly operatively coupled to an AR variant rifle receiver that does not include a protruding recoil buffer tube, in accordance with the present invention.

Referring now to FIG. 11, in some embodiments, firearm receiver 1180 is configured to be operatively coupled to a buffer-tubeless upper receiver (not shown). Accordingly, firearm stock assembly includes a cheek-rest 1160 configured to be secured to elongated support section 120, and configured to align the user's eye with a firearm aiming device having an elevated aiming axis relative to the firearm's bore axis, while maintaining an appropriate cheek weld.

Many modifications and additions are also possible. For example, butt plate 130 can be separate component (as described above) or integrated into the two halves. Butt plate 130 can be adjustable and/or constructed using the same material as the rest of the stock or using another suitable material including recoil absorbing materials such as rubber or neoprene. Other possible modifications include a hollow grip portion configured to store ammunition, batteries and/or maintenance tools.

Advantages of inline grip portion for the sporterized stock described above include grip angle familiarity preferred by many sportsmen, and compliance with applicable laws and regulation, while preserving functionality and usability for the users.

The firearm stock ensembles described above can be manufactured using suitable processes known to one skilled in the art. These manufacturing processes include injection molding, machining, three-dimensional printing (e.g., Stratasys Inc. of Eden Prairie, Minn.), die casting, forging or combination thereof Materials are suitable fabricating the various components of firearm stock ensembles described above include suitable metal alloys such as aluminum, titanium, and/or steel, and/or suitable polymers such as polycarbonate, nylon-impregnated plastics and/or Delrin™. To enhance durability and/or lubricity, the components of stock ensembles described above can also be painted, powder-coated, electroplated and/or rubberized. In addition to or in place of mechanical fastening techniques such as using screws and threaded holes described above, other installation techniques are also possible, including welding, adhesives, chemical bonding, heat bonding and combinations thereof.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A sporterized firearms stock ensemble useful in association with a long firearm configured to accept a pistol grip, the firearm stock ensemble comprising:

a cheek-rest configured to be operatively coupled to a recoil buffer tube of a long firearm, and a sporterized gunstock assembly including:

a receiver interface having a pair of adjacent surfaces configured to be directly attached to a pistol grip interface of the long firearm, wherein the pair of adjacent surfaces are perpendicular to each other, and wherein the adjacent surfaces are oriented in a vertical plane and a horizontal plane, respectively;

a sporterized grip portion configured to be substantially inline with respect to the gunstock assembly, wherein the sporterized grip portion includes a partially upward-oriented and partially backward-oriented upper profile and a corresponding partially downward-oriented and partially forward-oriented concave lower profile configured to be gripped by a firing hand of a user utilizing a sporterized rifle hand grip, wherein the upper profile of the sporterized grip portion includes a convex portion configured to accommodate a palm of the firing hand, wherein the upper profile of the sporterized grip portion includes a concave portion configured to accommodate a hand web located between a thumb and a trigger finger of the firing hand, and wherein the concave lower profile of the sporterized grip portion is configured to be cupped by a middle finger, a ring finger and a pinky finger of the firing hand, thereby increasing grip stability and controllability during live firing of the firearm;

a butt-plate configured to enable a user to support the long firearm with a shoulder of the user; and an elongated support section configured to couple a lower part of the grip portion to the butt-plate.

2. The firearm stock ensemble of claim 1 further comprising a sling interface configured to be detachably coupled to a sling.

3. The firearm stock ensemble of claim 1 wherein the receiver interface includes a block configured to retain a spring configured to be operatively coupled to a receiver.

4. The firearm stock ensemble of claim 1 wherein the long firearm is a semi-automatic capable firearm.

5. The firearm stock ensemble of claim 4 wherein the semi-automatic capable firearm is a rifle.

6. The firearm stock ensemble of claim 1 further comprising a buffer tube cover configured to be attached to the recoil buffer tube, and the buffer tube cover includes a rail configured to accept the cheek-rest configured to be snapped onto the rail.

7. The firearm stock ensemble of claim 1 wherein the cheek-rest is ambidextrous.

8. A sporterized gunstock assembly useful in association with a long firearm configured to accept a pistol grip, the gunstock assembly comprising:

a receiver interface having a pair of adjacent surfaces configured to be directed attached to a pistol grip interface of the long firearm, wherein the pair of adjacent surfaces are perpendicular to each other, and wherein the adjacent surfaces are oriented in a vertical plane and a horizontal plane, respectively;

a sporterized grip portion configured to be substantially inline with respect to the gunstock assembly, wherein the sporterized grip portion includes a partially upward-oriented and partially backward-oriented upper profile and a corresponding partially downward-oriented and partially forward-oriented concave lower profile configured to be gripped by a firing hand of a user utilizing a sporterized rifle hand grip, wherein the upper profile of the sporterized grip portion includes a convex portion configured to accommodate a palm of the firing hand, wherein the upper profile of the sporterized grip portion includes a concave portion configured to accommodate a hand web located between a thumb and a trigger finger of the firing hand, and wherein the concave lower profile of the sporterized grip portion is configured to be cupped by a middle finger, a ring finger and a pinky finger of the firing hand, thereby increasing grip stability and controllability during live firing of the firearm;

a butt-plate configured to enable a user to support the long firearm with a shoulder of the user;

an elongated support section configured to couple a lower part of the grip portion to the butt-plate; and a cheek-rest configured to be operatively coupled to the elongated support section.

9. The gunstock assembly of claim 8 further comprising a sling interface configured to be detachably coupled to a sling.

10. The gunstock assembly of claim 9 wherein the sling interface is adjacent to the butt-plate and wherein the gunstock assembly further comprises a secondary sling interface adjacent to the grip portion.

11. The gunstock assembly of claim 8 wherein the receiver interface includes a block configured to retain a spring configured to be operatively coupled to a receiver.

12. The gunstock assembly of claim 8 wherein the long firearm is a semi-automatic capable firearm.

13. The gunstock assembly of claim 12 wherein the semi-automatic capable firearm is a rifle.

14. The gunstock assembly of claim 8 wherein the cheek-rest is ambidextrous.

15. The gunstock assembly of claim 8 wherein the cheek-rest is adjustable with respect to the elongated support section.

* * * * *